US011851304B2

(12) United States Patent
Kinjarapu et al.

(10) Patent No.: US 11,851,304 B2
(45) Date of Patent: Dec. 26, 2023

(54) METHOD AND ARRANGEMENT

(71) Applicant: KONE Corporation, Helsinki (FI)

(72) Inventors: Arvind Kinjarapu, Helsinki (FI); Håkan Bärneman, Helsinki (FI); Hector Garcia, Helsinki (FI); Areli Borrego, Helsinki (FI); Martti Juurioksa, Helsinki (FI); Antonio Ibarra, Helsinki (FI)

(73) Assignee: KONE CORPORATION, Helsinki (FI)

( * ) Notice: Subject to any disclaimer, the term of this patent is extended or adjusted under 35 U.S.C. 154(b) by 302 days.

(21) Appl. No.: 17/201,254

(22) Filed: Mar. 15, 2021

(65) Prior Publication Data

US 2021/0198084 A1 Jul. 1, 2021

Related U.S. Application Data

(63) Continuation of application No. PCT/US2018/055839, filed on Oct. 15, 2018.

(51) Int. Cl.

| | |
|---|---|
| ***B66B 19/00*** | (2006.01) |
| ***B66B 7/02*** | (2006.01) |
| ***B66B 11/00*** | (2006.01) |

(52) U.S. Cl.

CPC ..... *B66B 19/002* (2013.01); *B66B 7/02* (2013.01); *B66B 11/0045* (2013.01)

(58) Field of Classification Search

CPC ..... B66B 19/002

See application file for complete search history.

(56) References Cited

U.S. PATENT DOCUMENTS

| | | | |
|---|---|---|---|
| 3,851,736 | A | 12/1974 | Westlake et al. |
| 5,020,641 | A | 6/1991 | Olsen et al. |

(Continued)

FOREIGN PATENT DOCUMENTS

| | | | |
|---|---|---|---|
| EP | 2 746 210 | A1 | 6/2014 |
| EP | 3 093 262 | A1 | 11/2016 |

(Continued)

OTHER PUBLICATIONS

Machine Translation of JP 2005-178947.*

(Continued)

*Primary Examiner* — Diem M Tran

(74) *Attorney, Agent, or Firm* — Birch, Stewart, Kolasch & Birch, LLP

(57) ABSTRACT

A method for installing guide rails of an elevator in a hoistway includes installing one or more guide rails to form a vertical guide rail line; positioning an elevator car at a first position in the hoistway; placing a plurality of guide rails to stand in an upright position on the elevator car such that each of the guide rails rests on the floor structure of the elevator car; supporting the upper half of each of the guide rails laterally on the elevator car for blocking its lateral movement relative to the elevator car; hoisting the elevator car in the hoistway upwards to a second position, along the guide rail line; and installing a guide rail belonging to said plurality into the elevator hoistway on top of the guide rail line for extending the guide rail line vertically, thereby making the guide rail being installed to form the uppermost section of the guide rail line. An installation arrangement of guide rails is provided for implementing the method.

18 Claims, 6 Drawing Sheets

(56) References Cited

U.S. PATENT DOCUMENTS

| | | | | |
|---|---|---|---|---|
| 5,065,843 | A * | 11/1991 | Richards | B66B 19/002 187/408 |
| 6,481,538 | B2 | 11/2002 | Blackaby et al. | |
| 8,291,568 | B2 * | 10/2012 | Barneman | B66B 19/00 29/431 |
| 9,592,997 | B2 | 3/2017 | Mertala | |
| 9,617,121 | B2 * | 4/2017 | Bolme | B66B 19/002 |
| 9,890,019 | B2 * | 2/2018 | Kere | E04G 3/28 |
| 2009/0266651 | A1 | 10/2009 | Van Der Meijden et al. | |
| 2011/0113720 | A1 | 5/2011 | Peacock et al. | |
| 2015/0314993 | A1 | 11/2015 | Bolme et al. | |

FOREIGN PATENT DOCUMENTS

| | | | | | |
|---|---|---|---|---|---|
| JP | 5-178561 | A | | 7/1993 | |
| JP | 7-291550 | A | | 11/1995 | |
| JP | 11011822 | A | * | 1/1999 | B66B 19/002 |
| JP | 2005178947 | A | * | 7/2005 | B66B 19/002 |

OTHER PUBLICATIONS

International Search Report, issued in PCT/US2018/055839, dated Dec. 10, 2018.
Written Opinion of the International Searching Authority, issued in PCT/US2018/055839, dated Dec. 10, 2018.
Extended European Search Report for European Application No. 18937118.0, dated Mar. 28, 2022.

* cited by examiner

METHOD AND ARRANGEMENT

CROSS REFERENCE TO RELATED APPLICATIONS

This application is a Continuation of PCT International Application No. PCT/US2018/055839, filed on Oct. 15, 2018, which is hereby expressly incorporated by reference into the present application.)

FIELD OF THE INVENTION

The invention relates to a method for installing guide rails of an elevator, a method for installing an elevator and an installation arrangement of an elevator. The elevator is preferably an elevator for vertically transporting passengers and/or goods.

BACKGROUND OF THE INVENTION

Elevators typically comprise an elevator car traveling along two guide rail lines. The guide rails are normally installed such that guide rails of a certain length are fixed into position one above the other in sequence from the bottom upwards so that they together form a long vertically oriented guide rail line. Often scaffolds and auxiliary hoists are used to aid the installation work. The guide rails are moved to position typically by lifting them one at a time using an auxiliary hoist. After lifting, each guide rail is fixed immovably to a hoistway wall using brackets. At this phase, the guide rail is also fixed with a fish plate immovably to a previously installed guide rail below it. The person performing the installation typically works from a movable platform or a scaffold.

A drawback of the prior installation solutions has been that they are time consuming. A further concern is that the installation process has required a lot of measures for ensuring safety during the lifting and fixing of the guide rails.

BRIEF DESCRIPTION OF THE INVENTION

The object of the invention is to provide an improved solution for performing elevator guide rail installation. An object is particularly to alleviate one or more of the above defined drawbacks of prior art and/or problems discussed or implied elsewhere in the description. Solutions are presented, inter alia, which facilitate swiftness of elevator guide rail installation. Solutions are presented, inter alia, which facilitate safety of elevator guide rail installation. Solutions are presented, inter alia, which make possible that small amount of aid equipment, such as auxiliary hoists or scaffolds, are needed in the installation of elevator guide rails.

It is brought forward a new method for installing guide rails of an elevator in a hoistway, comprising

- installing one or more guide rails to form a vertical guide rail line;
- positioning an elevator car at a first position in the hoistway; and
- placing plurality of guide rails to stand in an upright position on the elevator car such that each of the guide rails rests on the floor structure of the elevator car; and
- supporting the upper half of each of the guide rails laterally on the elevator car for blocking its lateral movement relative to the elevator car; and
- hoisting the elevator car in the hoistway upwards to a second position, along the guide rail line; and

- installing a guide rail belonging to said plurality into the elevator hoistway on top of the guide rail line for extending the guide rail line vertically, thereby making the guide rail being installed to form the uppermost section of the guide rail line. With this solution, one or more of the above mentioned advantages and/or objectives are achieved. Hereby, a plurality of guide rails can be swiftly and safely moved to their positions and installed therein.

Preferable further steps or features are introduced in the following, which further steps or features can be combined with the method individually or in any combination.

In a preferred embodiment, the method comprises after said installing hoisting the elevator car in the hoistway upwards to a third position, and installing a guide rail belonging to said plurality of guide rails into the elevator hoistway on top of the guide rail line for extending it vertically, thereby making the guide rail being installed to form the uppermost section of the guide rail line. Hereby, a plurality of guide rails can be swiftly and safely moved to their positions and installed therein. An advantage is that small amount of back and forth movement is needed.

In a preferred embodiment, the method comprises after installing all guide rails belonging to said plurality of guide rails, returning the car to a lower position, preferably to the first position for picking up a second plurality of guide rails, and thereafter repeating said placing and supporting and thereafter hoisting the elevator car in the hoistway upwards along the guide rail line, and thereafter installing a guide rail belonging to the second plurality (i.e. the one placed in the latter placing) into the elevator hoistway on top of the guide rail line for extending it vertically, thereby making the guide rail being installed to form the uppermost section of the guide rail line.

In a preferred embodiment, said supporting the upper half of each of the guide rails laterally on the elevator car comprises supporting the upper half of each of the guide rails laterally on the elevator car with a support equipment. This ensures reliable control of guide rail position in the hoisting, which facilitates safety and space efficiency of the method.

In a preferred embodiment, said floor structure is the floor platform of the car delimiting the interior of the elevator car. A protective cover can be placed between the guide rails and the floor in order to protect the floor from being scratched. Moreover, a lateral support equipment can also be provided for the lower ends of the guide rails.

In a preferred embodiment, the method comprises supporting the lower ends of the guide rails laterally on the elevator car for blocking their lateral movement relative to the elevator car.

In a preferred embodiment, in said placing said plurality guide rails are placed to stand on the floor structure of the elevator car such that they rest on the upwards facing face of the floor platform delimiting the interior of the elevator car.

In a preferred embodiment, in said placing said plurality guide rails are placed to stand on the floor structure of the elevator car such that the lower end of each of the guide rails is inside the interior of the elevator car, and the upper end is outside the interior of the elevator car. The upper end can protrude into the hoistway through the ceiling of the car, particularly, e.g. through an opening thereof.

In a preferred embodiment, at the time of said placing, the elevator car comprises a ceiling delimiting said interior.

In a preferred embodiment, at the time of said placing, the elevator car comprises walls delimiting said interior.

In a preferred embodiment, in said placing said plurality guide rails to stand on the floor structure of the elevator car such that they extend through an opening, in particular an escape hatch opening, of the car ceiling.

In a preferred embodiment, said supporting the upper half of each of the guide rails laterally on the elevator car comprises supporting the upper half of each of the guide rails laterally on the elevator car with a support equipment such that it extends through the opening at a distance from the edges of the opening.

In a preferred embodiment, the support equipment is or at least comprises a cover plate covering the opening at least partially, preferably more than 50% of the area thereof.

In a preferred embodiment, the support equipment comprises plurality of seats for guide rails, each preferably being arranged to receive one guide rail.

In a preferred embodiment, the seats are guide rail openings, each being arranged to receive one guide rail such that the guide rail extends through the guide rail opening.

In a preferred embodiment, each guide rail opening is T-shaped, and the cross section of each guide rail is T-shaped.

In a preferred embodiment, the cover plate is a hatch door.

In a preferred embodiment, the opening is rectangular, all its sides being less than 1 m.

In a preferred embodiment, no other openings extend vertically through the ceiling apart from said opening.

In a preferred embodiment, the vertical projection of the ceiling covers completely the interior of the elevator car apart from said opening.

In a preferred embodiment, said floor structure is the sill structure of the elevator car forming a laterally extending protrusion on the car.

In a preferred embodiment, in said placing said plurality guide rails are placed to stand on the sill structure such that each of them extends on one side of the elevator car outside the interior thereof.

In a preferred embodiment, in said placing said plurality guide rails are placed to stand on an upwards facing face of the sill structure.

In a preferred embodiment, said supporting equipment is mounted on the car higher than the upper edge of the doorway of the car leading into the interior.

In a preferred embodiment, said supporting equipment comprises at least one support collar comprising an opening through which a guide rail can be placed to extend.

In a preferred embodiment, said supporting equipment comprises a support collar per each of the plurality of guide rails.

In a preferred embodiment, the collar is preferably openable or removable from the car for facilitating placing of the guide rail through the opening thereof.

It is also brought forward a new installation arrangement of guide rails an elevator, comprising a hoistway; one or more guide rails forming a vertical guide rail line; an elevator car at a first position in the hoistway; a plurality of guide rails placed to stand in an upright position on the elevator car such that each of the guide rails rests on the floor structure of the elevator car; the upper half of each of the guide rails being supported laterally on the elevator car for blocking its lateral movement relative to the elevator car; and a hoisting arrangement for hoisting the elevator car in the hoistway upwards to a second position along the guide rail line. With this solution, one or more of the above mentioned advantages and/or objectives are achieved.

Preferable further features have been introduced earlier above as well as in the following, which further features can be combined with the arrangement individually or in any combination.

In a preferred embodiment, said floor structure is the floor platform of the car delimiting the interior of the elevator car.

In a preferred embodiment, said plurality guide rails stand on the floor structure of the elevator car such that they rest on the upwards facing face of the floor platform delimiting the interior of the elevator car. The plurality guide rails can then stand directly against the upwards facing face of the floor platform delimiting the interior of the elevator car or via a cover, such as a cover for protecting the surface of the floor platform.

In a preferred embodiment, said plurality guide rails stand on the floor structure of the elevator car such that the lower end of each of the guide rails is inside the interior of the elevator car, and the upper end is outside the interior of the elevator car. The upper end can protrude into the hoistway through the ceiling of the car, particularly, e.g. through an opening thereof.

In a preferred embodiment, the elevator car comprises a ceiling delimiting said interior.

In a preferred embodiment, the elevator car comprises walls delimiting said interior.

In a preferred embodiment, said plurality guide rails stand on the floor structure of the elevator car such that they extend through an opening, such as an escape hatch opening for example, of the car ceiling.

In a preferred embodiment, the upper half of each of the guide rails is supported laterally on the elevator car with a support equipment such that it extends through the opening at a distance from the edges of the opening.

In a preferred embodiment, the support equipment is or at least comprises a cover plate covering the opening at least partially, preferably more than 50% of the area thereof.

In a preferred embodiment, the support equipment comprises plurality of seats for guide rails, each preferably being arranged to receive one guide rail.

In a preferred embodiment, the seats are guide rail openings, each being arranged to receive one guide rail such that the guide rail extends through the guide rail opening.

In a preferred embodiment, each guide rail opening is T-shaped, and the cross section of each guide rail is T-shaped.

In a preferred embodiment, the cover plate is a hatch door.

In a preferred embodiment, the opening is rectangular, all its sides being less than 1 m.

In a preferred embodiment, no other openings extend vertically through the ceiling apart from said opening.

In a preferred embodiment, the vertical projection of the ceiling covers completely the interior of the elevator car apart from said opening.

In a preferred embodiment, said floor structure is the sill structure of the elevator car forming a laterally extending protrusion on the car.

In a preferred embodiment, said plurality guide rails stand on the sill structure such that each of them extends on one side of the elevator car outside the interior thereof.

In a preferred embodiment, in said placing said plurality guide rails stand on an upwards facing face of the sill structure.

In a preferred embodiment, said supporting the upper half of each of the guide rails laterally on the elevator car comprises supporting the upper half of each of the guide rails laterally on the elevator car with a support equipment.

In a preferred embodiment, said supporting equipment is mounted on the car higher than the upper edge of the doorway of the car leading into the interior.

In a preferred embodiment, said supporting equipment comprises at least one support collar comprising an opening through which a guide rail can be placed to extend.

In a preferred embodiment, said supporting equipment comprises a support collar per each of the plurality of guide rails.

In a preferred embodiment, the collar is preferably openable or removable from the car for facilitating placing of the guide rail through the opening thereof.

In a preferred embodiment, the lower ends of the guide rails are supported by a second support equipment. The second support equipment can comprise one or more brackets mounted on the car, such as one or more timber elements, for example timber elements placed to extend across the interior of the car. Alternatively, a more complicated bracket could be used.

It is also brought forward a new method for installing an elevator, wherein the method comprises the method for installing guide rails of an elevator in a hoistway as defined anywhere above, and thereafter taking the elevator into use for transporting passengers.

In a preferred embodiment, the said use comprises moving the elevator car under automatic control in response to passenger input received via one or more user interfaces, said control preferably being performed by an electronic elevator control system comprising one or more electrically powered microprocessors for example.

Generally, one or more of the steps of the installation methods could be arranged to be performed automatically. This would make the installation process more efficient. For example, the step of placing plurality of guide rails 1 to stand as defined could be performed automatically by a robot. For example, the hoisting could be controlled automatically by a computer for controlling a hoisting arrangement. For example, installing a guide rail 1 belonging to said plurality into the elevator hoistway as defined could be performed automatically by a robot such as a robot carried by the car. Performing all these steps automatically by a robot and/or computer, would particularly make the guide rail installation process highly efficient.

The elevator mentioned is in general preferably such that it comprises (or is being constructed to comprise) a plurality of landings, and the elevator car, when the elevator is in use for transporting passengers, is vertically movable to and from each of said plurality of landings, preferably under automatic control in response to passenger input received via one or more user interfaces, said control preferably being performed by an electronic elevator control system comprising one or more electrically powered microprocessors for example.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
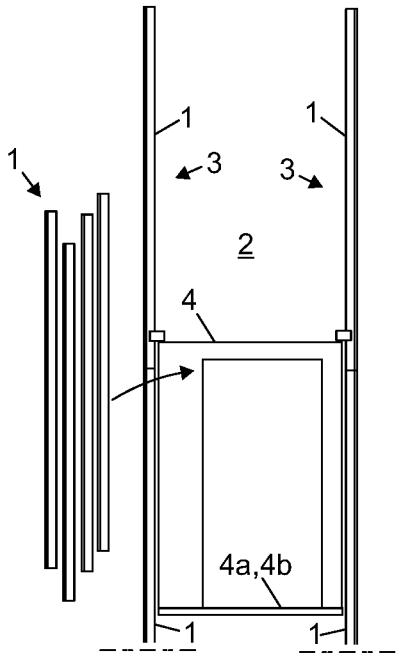
FIGS. 1-4 illustrate from a side phases of the method according to a first embodiment.
Figure 2:
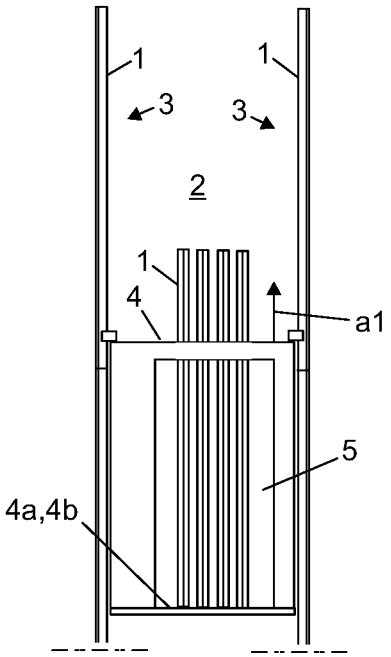
Figure 3:
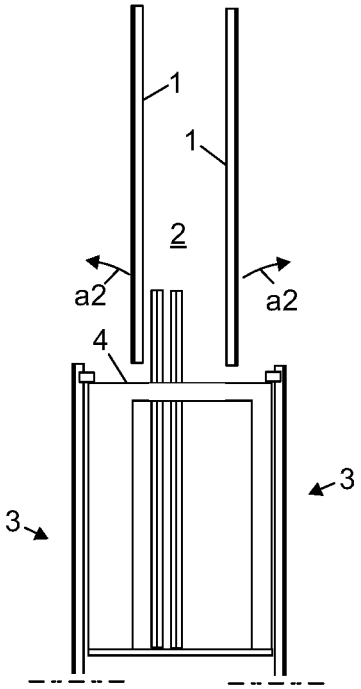
Figure 4:
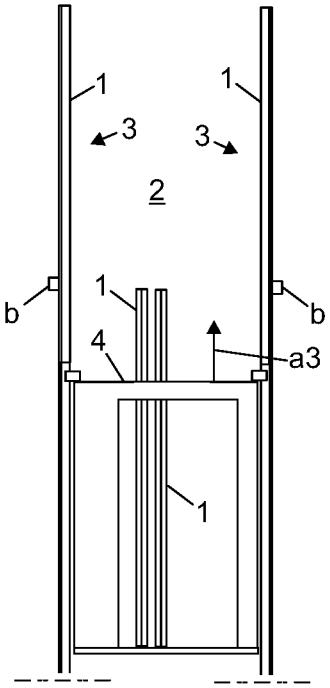

In a first embodiment of a method for installing guide rails 1 of an elevator in a hoistway 2, the method comprises installing one or more guide rails 1 to form a vertical guide rail line 3, and positioning an elevator car 4 at a first position in the hoistway. FIG. 1 illustrates a phase of the first embodiment of a method wherein these steps have been performed. In the presented case, in this way guide rails 1 have been installed to form two guide rail lines 3 extending vertically parallel to each other. FIG. 1 also illustrates a step of the method where plurality of guide rails 1 are placed to stand in an upright position on the elevator car 4 such that each of the guide rails 1 rests on the floor structure 4*a* of the elevator car 4. In said placing or right after it, the upper half of each of the guide rails 1 is supported laterally on the elevator car 4 for blocking its lateral movement relative to the elevator car 4. The guide rails thus placed and supported have been illustrated in FIG. 2. After said placing and supporting, the elevator car 4 carrying the plurality of guide rails 1 is hoisted, as indicated by the arrow a1 in FIG. 2, in the hoistway 2 upwards to a second position, along the at least one guide rail line 3. FIG. 3 illustrates the elevator car 4 in said second position. After said hoisting of the car 4 to said second position, the method comprises installing a guide rail 1 belonging to the aforementioned plurality of guide rails 1 into the elevator hoistway 2 on top of the guide rail line 3 for extending the guide rail line 3 vertically, thereby making the guide rail 1 being installed to form the uppermost section of the guide rail line 3. Said installing the guide rail 1 being installed to form the uppermost section of the guide rail line 3 comprises moving each guide rail 1 to its place and fixing it there with brackets b for example. The brackets b can be mounted in the method on a wall of the hoistway 2 for example, or any other structure of the building where the hoistway 2 is located. Arrows a2 indicate movement of the guide rails 1 in context of said installing. FIG. 4 illustrates the method phase when the guide rails 1 have been thus installed.

In the presented case, at the phase illustrated in FIG. 4, there are still guide rails 1 carried by the car 4 since the aforementioned plurality of guide rails 1 included guide rails 1 a number (in the example four) sufficient to enable installing of more than one section of the guide rail line(s) 3. Therefore, after said installing the guide rails 1 being installed to form the uppermost section of the guide rail line 3, the method comprises hoisting the elevator car 4 in the hoistway upwards to a third position as indicated by arrow a3. After this (second) hoisting, the method comprises once more installing a guide rail 1 belonging to said plurality into the elevator hoistway 2 on top of the guide rail line 3 for extending it vertically, thereby making the guide rail being installed to form the uppermost section of the guide rail line 3. In this step, the guide rail is of course installed on top of the guide rail 1 installed in a preceding installation step, i.e. in the step illustrated in FIG. 3.

Preferably, the method comprises after installing all guide rails belonging to said plurality of guide rails 1, returning the car 4 to a lower position, preferably to the first position for picking up a second plurality of guide rails 1, and thereafter repeating said placing and supporting and thereafter hoisting the elevator car in the hoistway 2 upwards along the guide rail line, and thereafter installing a guide rail (belonging to the second plurality placed in the latter placing) into the elevator hoistway 2 on top of the guide rail line 3 for extending it vertically, thereby making the guide rail being installed to form the uppermost section of the guide rail line.

This time, in the hoisting the elevator car is hoisted in the hoistway 2 upwards along the guide rail line to a position which is even higher than said second (and third position if the car was lifted to this position for installing guide rails).

Figure 5:
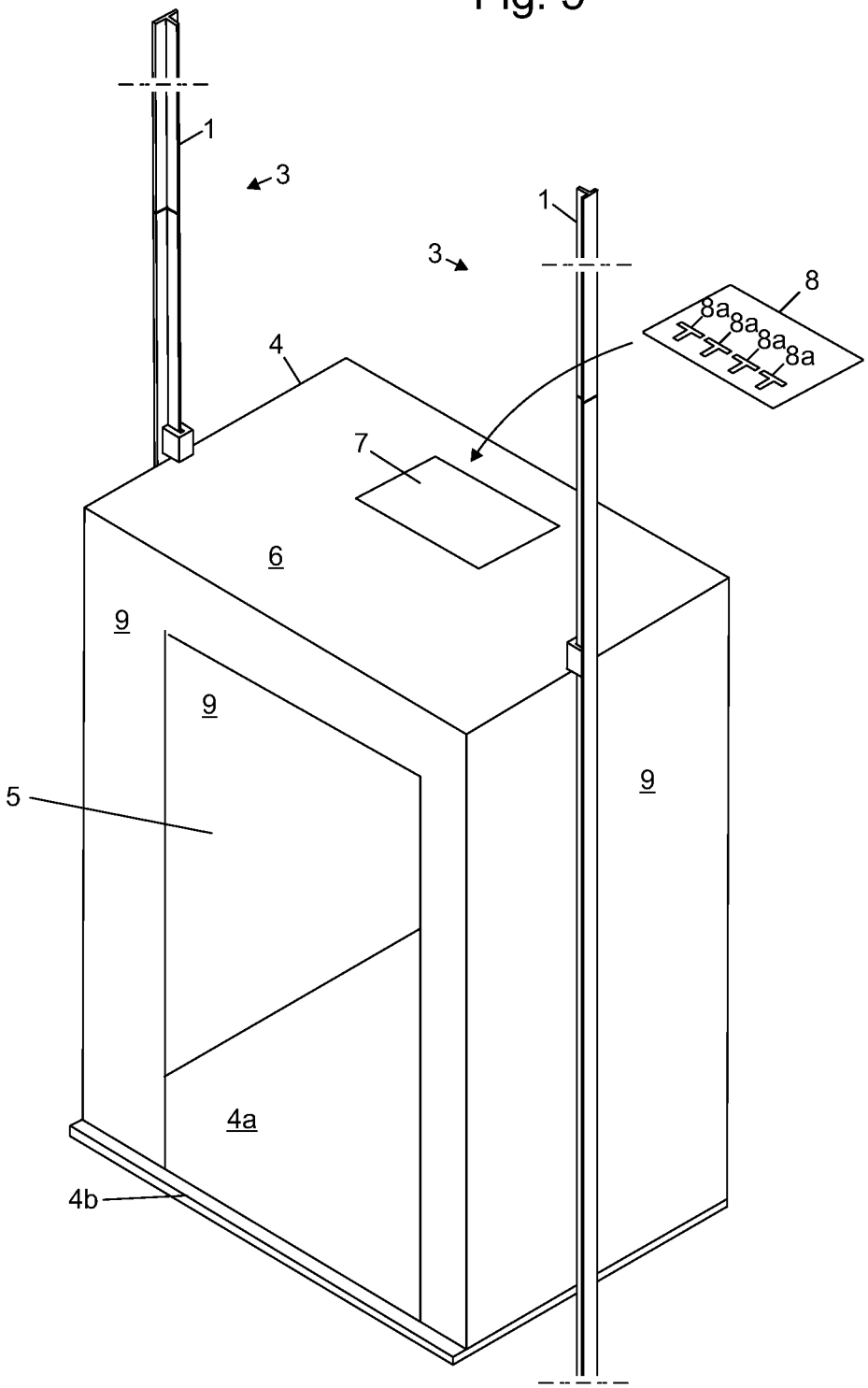
FIG. 5 illustrates three dimensionally the elevator car, an opening of the ceiling of the elevator car and a support equipment preferably used in the method according to the first embodiment.

Said floor structure 4*a* is in a first embodiment the floor platform of the car 4 delimiting the interior 5 of the elevator car 4. Then, in said placing said plurality guide rails are particularly placed to stand on the floor structure of the elevator car such that they rest on the upper face of the floor platform delimiting the interior 5 of the elevator car 4. FIGS. 2 and 5 illustrate preferred details of how the guide rails 1 are placed and supported in the method according the first embodiment Preferably, in the first embodiment, in said placing said plurality guide rails 1 are placed to stand on the floor structure 4*a* of the elevator car 4 such that the lower end 1*a* of each of the guide rails is inside the interior 5 of the elevator car, and the upper end is outside the interior 5 of the elevator car 4. This has been illustrated in FIGS. 1-4 and 6.

At the time of said placing said plurality guide rails 1 to stand on the floor structure 4*a* of the elevator car 4 such that the lower end 1*a* of each of the guide rails is inside the interior 5 of the elevator car, the elevator car comprises a ceiling 6 delimiting said interior 5. The placing is then performed such that the guide rails 1 extend through an opening 7, such as an escape hatch opening, of the car ceiling 6. Preferably, at the time of said placing, the elevator car 4 also comprises walls 9 delimiting said interior 5. It is preferred that the elevator car 4 is the final elevator car 4 of the elevator.

Figure 6:
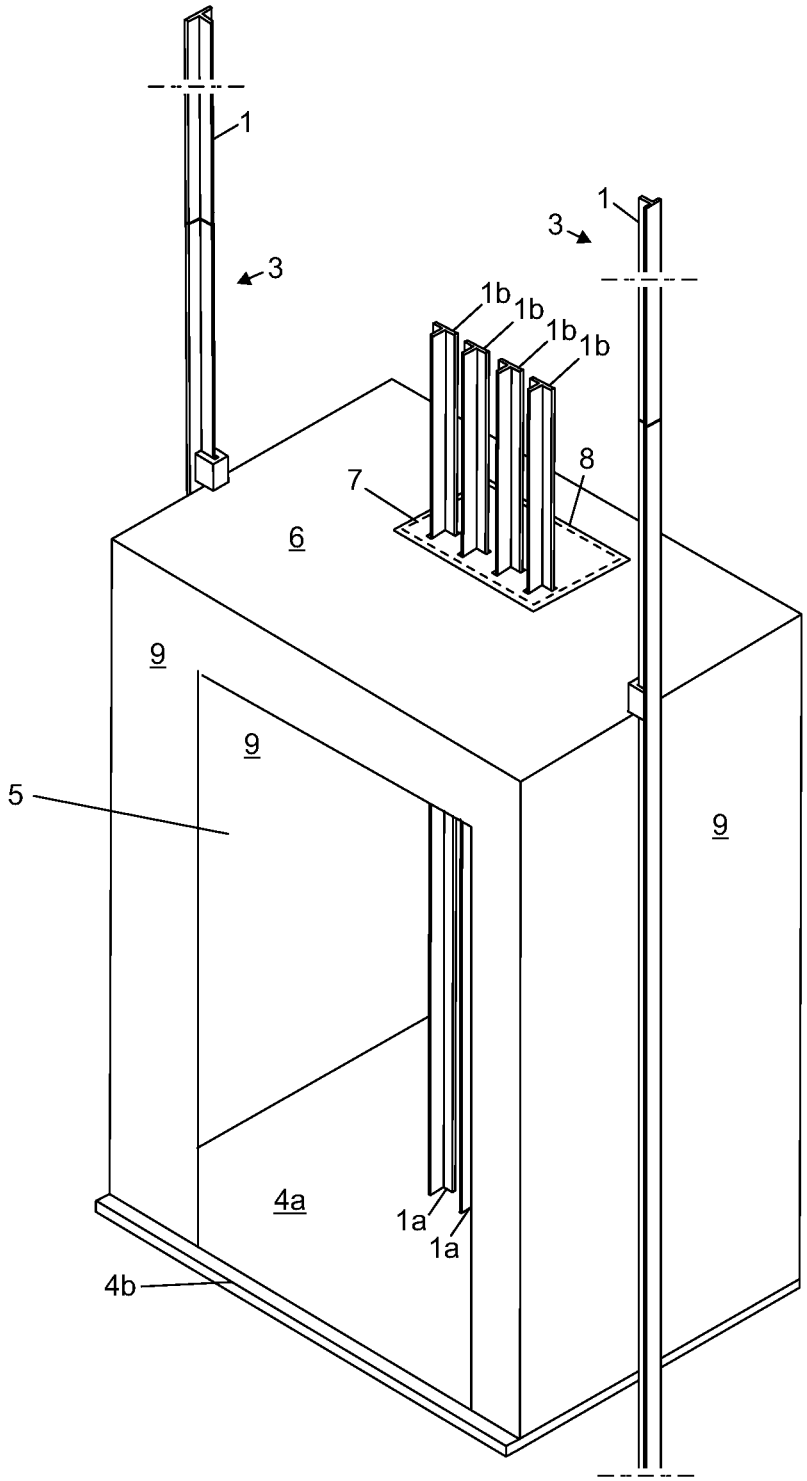
FIG. 6 illustrates three dimensionally preferred details of how the guide rails are placed and supported in the first embodiment.

Preferably, said supporting the upper half of each of the guide rails 1 laterally on the elevator car 4 comprises supporting the upper half of each of the guide rails 1 laterally on the elevator car 4 with a support equipment 8 such that it extends through the opening 7 at a distance from the edges of the opening, as illustrated in FIG. 6.

The support equipment 8 comprises plurality of seats 8*a* for guide rails 1, each being arranged to receive one guide rail 1. In the embodiment of FIG. 6, the support equipment 8 is a cover plate. The cover plate 8 facilitates supporting of the guide rails 1 at a desired position with a simple structure. The cover plate in the presented case covers the opening 7, in particular more than 50% of the area thereof, whereby it also facilitates closing of the interior.

The seats 8*a* are in the presented embodiment guide rail openings 8*a*, each being arranged to receive one guide rail 1 such that the guide rail extends through the guide rail opening 8*a*. Each guide rail opening 8*a* is T-shaped, and the cross section of each guide rail 1 is T shaped, whereby an effective support can be achieved. The cover plate 8 can be a one piece structure or structure of plurality of pieces releasably fixed to each other so that the guide rail openings 8*a* can be enlarged or opened such that positioning of the guide rail 1 into it is made easier.

In the embodiment of FIG. 6, the opening is rectangular 7, all its sides being less than 1 m. Thus, it is well usable as an escape hatch opening, of the car ceiling 6 in the final elevator.

The cover plate 8 can also be a hatch door. In this case, the openings 8*a* may need to be covered later or some components of the hatch changed.

The ceiling 6 preferably covers completely the interior apart from said opening 7. In other words, no other openings extend vertically through the ceiling 6 apart from said opening 7. This facilitates using an elevator car 4 which is to serve later for transporting passengers.

Figure 7:
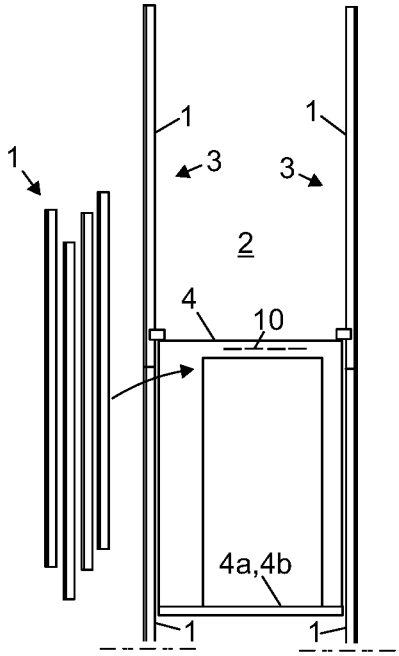
FIGS. 7-10 illustrate from a side phases of the method according to a second embodiment.
Figure 8:
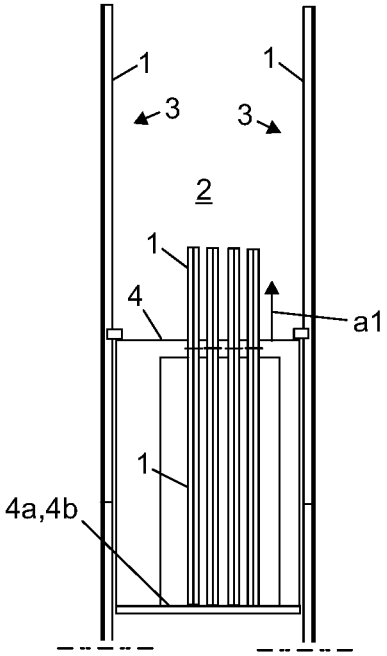
Figure 9:
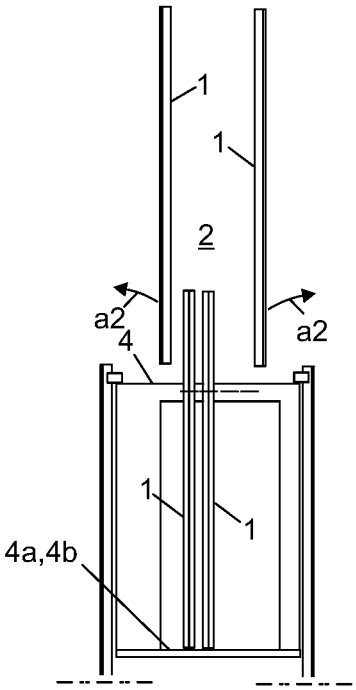
Figure 10:
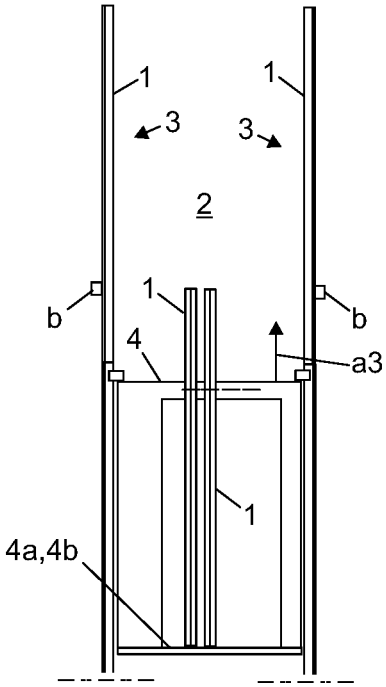

In a second embodiment of a method for installing guide rails 1 of an elevator in a hoistway 2, the method comprises installing one or more guide rails 1 to form a vertical guide rail line 3, and positioning an elevator car 4 at a first position in the hoistway. FIG. 7 illustrates a phase of the first embodiment of a method wherein these steps have been performed. In the presented case, in this way guide rails 1 have been installed to form two guide rail lines 3 extending vertically parallel to each other. FIG. 7 also illustrates a step of the method where plurality of guide rails 1 are placed to stand in an upright position on the elevator car 4 such that each of the guide rails 1 rests on the floor structure 4*a*;4*b* of the elevator car 4. In said placing or right after it, the upper half of each of the guide rails 1 is supported laterally on the elevator car 4 for blocking its lateral movement relative to the elevator car 4. The guide rails thus placed and supported have been illustrated in FIG. 8. After said placing and supporting, the elevator car 4 carrying the plurality of guide rails 1 is hoisted, as indicated by the arrow a1 in FIG. 8, in the hoistway 2 upwards to a second position, along the at least one guide rail line 3. FIG. 9 illustrates the elevator car 4 in said second position. After said hoisting of the car 4 to said second position, the method comprises installing a guide rail 1 belonging to the aforementioned plurality of guide rails 1 into the elevator hoistway 2 on top of the guide rail line 3 for extending the guide rail line 3 vertically, thereby making the guide rail 1 being installed to form the uppermost section of the guide rail line 3. Said installing the guide rail 1 being installed to form the uppermost section of the guide rail line 3 comprises moving each guide rail 1 to its place and fixing it there with brackets b for example. The brackets b can be mounted in the method on a wall of the hoistway 2 for example, or any other structure of the building where the hoistway 2 is located. Arrows a2 indicate movement of the guide rails 1 in context of said installing. FIG. 10 illustrates the method phase when the guide rails 1 have been thus installed.

In the presented case, at the phase illustrated in FIG. 10, there are still guide rails 1 carried by the car 4 since the aforementioned plurality of guide rails 1 included guide rails 1 a number (in the example four) sufficient to enable installing of more than one section of the guide rail line(s) 3. Therefore, after said installing the guide rails 1 being installed to form the uppermost section of the guide rail line 3, the method comprises hoisting the elevator car 4 in the hoistway upwards to a third position as indicated by arrow a3. After this (second) hoisting, the method comprises once more installing a guide rail 1 belonging to said plurality into the elevator hoistway 2 on top of the guide rail line 3 for extending it vertically, thereby making the guide rail being installed to form the uppermost section of the guide rail line 3. In this step, the guide rail is of course installed on top of the guide rail 1 installed in a preceding installation step, i.e. in the step illustrated in FIG. 9.

Preferably, the method comprises after installing all guide rails belonging to said plurality of guide rails 1, returning the car 4 to a lower position, preferably to the first position for picking up a second plurality of guide rails 1, and thereafter repeating said placing and supporting and thereafter hoisting the elevator car in the hoistway 2 upwards along the guide rail line, and thereafter installing a guide rail (belonging to the second plurality placed in the latter placing) into the elevator hoistway 2 on top of the guide rail line 3 for extending it vertically, thereby making the guide rail being installed to form the uppermost section of the guide rail line.

This time, in the hoisting the elevator car 4 is hoisted in the hoistway 2 upwards along the guide rail line 3 to a position which is even higher than said second (and third position if the car was lifted to this position for installing guide rails).

Figure 11:
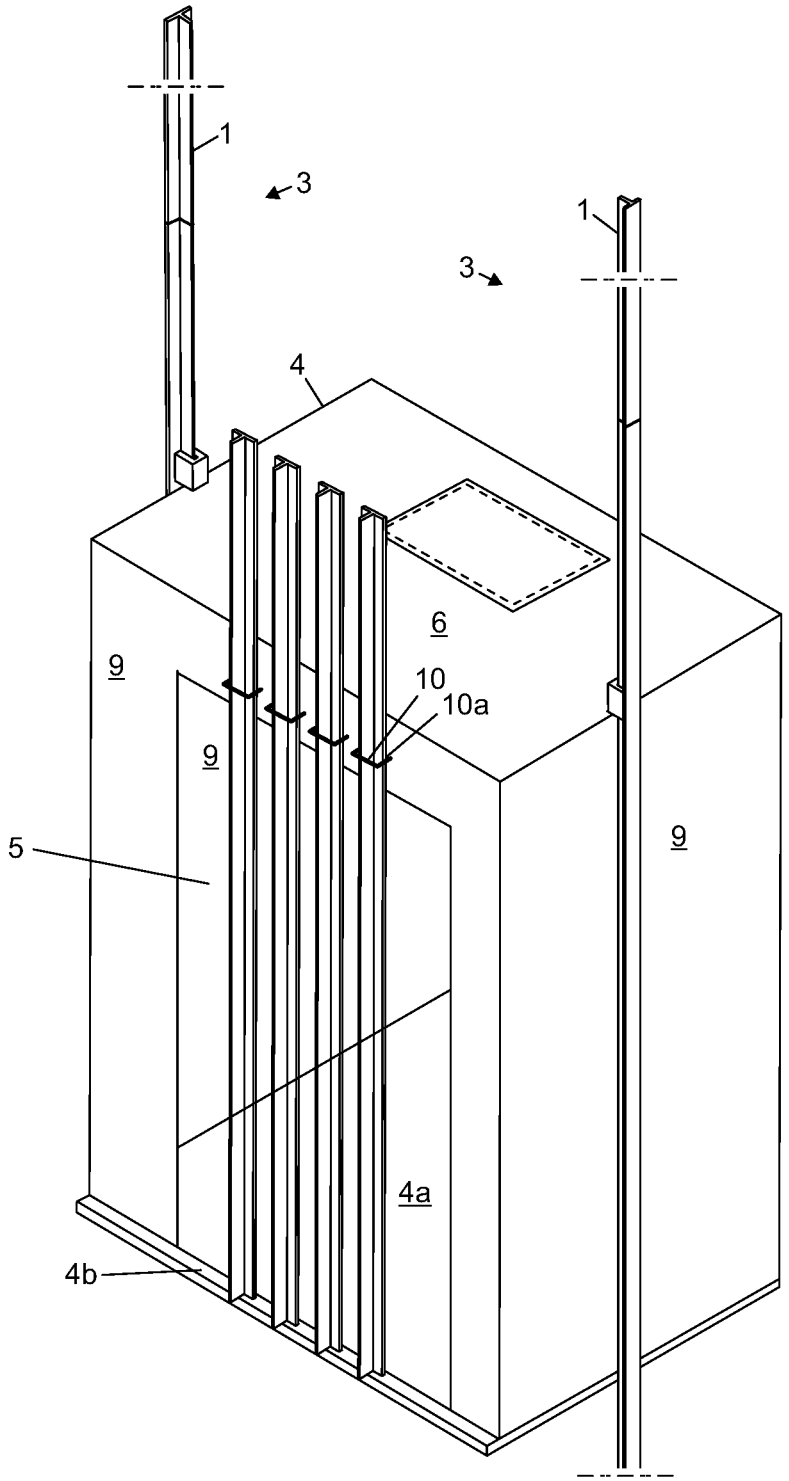
FIG. 11 illustrates three dimensionally preferred details of how the guide rails are placed and supported in the second embodiment.

Said floor structure 4*b* is in a second embodiment the sill structure of the elevator car 4 forming a laterally extending protrusion 4*b* on the car. Then, in said placing said plurality guide rails are particularly placed to stand on the sill structure 4*b* such that each of them extends on one side of the elevator car 4 outside the interior 5 thereof. FIGS. 8 and 11 illustrate preferred details of how the guide rails 1 are placed and supported in the method according the second embodiment. In said placing said plurality guide rails 1 are placed to stand on an upwards facing face of the sill structure 4*b*.

At the time of said placing said plurality guide rails 1 to stand on the floor structure 4*b* of the elevator car 4 the elevator car 4 also comprises walls 9 delimiting said interior 5. Preferably, at the time of said placing, the elevator car 4 also comprises a ceiling 6 delimiting said interior 5. It is preferred that the elevator car 4 is the final elevator car 4 of the elevator.

Preferably, said supporting the upper half of each of the guide rails 1 laterally on the elevator car 4 comprises supporting the upper half of each of the guide rails 1 laterally on the elevator car 4 with a support equipment 10.

Preferably, said supporting equipment 10 is mounted on the car 4 higher than the upper edge of the doorway of the car 4 leading into the interior 5. Thus, the upper halves of the guide rails 1 can be simply supported. Moreover, the supporting function is independent of position of the doorway.

The support equipment 10 comprises plurality of seats 10*a* for guide rails 1, each being arranged to receive one guide rail 1. In the embodiment of FIG. 11, said supporting equipment 10 comprises at least one support collar 10 comprising an opening through which a guide rail 1 can be placed to extend. Thus, the opening forms here the aforementioned seat. In the embodiment illustrated, said supporting equipment 10 comprises a support collar 10 per each of the plurality of guide rails.

The collar is preferably openable or removable from the car for facilitating placing of the guide rail through the opening thereof. The support collar 10 need not surround completely the guide rail 1.

An installation arrangement of guide rails 1 an elevator according to a first embodiment is illustrated in FIG. 2. Preferred details have been illustrated in FIG. 6. The installation arrangement, comprises one or more guide rails 1 forming a vertical guide rail line 3; an elevator car 4 at first position in the hoistway; plurality of guide rails 1 placed to stand in an upright position on the elevator car 4 such that each of the guide rails 1 rests on the floor structure 4*a* of the elevator car 4; the upper half of each of the guide rails 1 being supported laterally on the elevator car 4 such that its lateral movement relative to the elevator car 4 is blocked; and a hoisting arrangement 11,12 for hoisting the elevator car 4 in the hoistway 2 upwards to a second position, along the guide rail line 3.

In the embodiment of FIGS. 2 and 6, said floor structure 4*a* is the floor platform of the car 4 delimiting the interior 5 of the elevator car 4. Said plurality guide rails are stand on the floor structure of the elevator car such that they rest on the upwards facing face of the floor platform delimiting the interior 5 of the elevator car 4. Said plurality guide rails are placed to stand on the floor structure of the elevator car such that the lower end 1*a* of each of the guide rails is inside the interior 5 of the elevator car, and the upper end is outside the interior of the elevator car. The elevator car comprises a ceiling 6 delimiting said interior 5. The elevator car also comprises walls 9 delimiting said interior 5.

In the embodiment of FIGS. 2 and 6, said plurality guide rails stand on the floor structure of the elevator car such that they extend through an opening 7, in particular an escape hatch opening, of the car ceiling 6. The upper half of each of the guide rails is supported laterally on the elevator car with a support equipment (8) such that it extends through the opening 7 at a distance from the edges of the opening 7. The support equipment 8 is or at least comprises a cover plate covering the opening at least partially, preferably more than 50% of the area thereof. The support equipment 8 comprises plurality of seats 8*a* for guide rails 1, each being arranged to receive one guide rail 1. The seats are guide rail openings 8*a*, each being arranged to receive one guide rail 1 such that the guide rail extends through the guide rail opening 8*a*. Each guide rail opening 8*a* is T-shaped, and the cross section of each guide rail 1 is T-shaped. The cover plate 8 is preferably a hatch door. In the presented embodiment, the opening is rectangular 7, all its sides being less than 1 meter. No other openings extend vertically through the ceiling 6 apart from said opening. The vertical projection of the ceiling 6 covers completely the interior 5 of the elevator car apart from said opening 7.

An installation arrangement of guide rails 1 an elevator according to a second embodiment is illustrated in FIG. 8. Preferred details have been illustrated in FIG. 11. The installation arrangement, comprises one or more guide rails 1 forming a vertical guide rail line 3; an elevator car 4 at first position in the hoistway; plurality of guide rails 1 placed to stand in an upright position on the elevator car 4 such that each of the guide rails 1 rests on the floor structure 4*b* of the elevator car 4; the upper half of each of the guide rails 1 being supported laterally on the elevator car 4 such that its lateral movement relative to the elevator car 4 is blocked; and a hoisting arrangement 11,12 for hoisting the elevator car 4 in the hoistway 2 upwards to a second position, along the guide rail line 3.

In the embodiment of FIGS. 8 and 11, said floor structure 4*b* is the sill structure of the elevator car 4 forming a laterally extending protrusion 4*b* on the car 4.

Said plurality guide rails stand on the sill structure 4*b* such that each of them extends on one side of the elevator car 4 outside the interior 5 thereof. Said plurality guide rails 1 particularly stand on an upwards facing face of the sill structure 4*b*.

The upper half of each of the guide rails is 1 laterally supported on the elevator car with a support equipment 10.

Said supporting equipment 10 is mounted on the car 4 higher than the upper edge of the doorway of the car 4 leading into the interior 5.

The support equipment 10 comprises plurality of seats 10*a* for guide rails 1, each seat being arranged to receive one guide rail 1. Said supporting equipment 10 comprises at least one support collar 10 comprising an opening through which a guide rail 1 can be placed to extend. Thus, the opening forms here the aforementioned seat. Preferably, said supporting equipment 10 comprises a support collar 10 per each of the plurality of guide rails. The collar is preferably openable or removable from the car for facilitating placing of the guide rail through the opening thereof. The collar need not surround completely the guide rail, it can be made of one or plurality of components.

Figure 12:
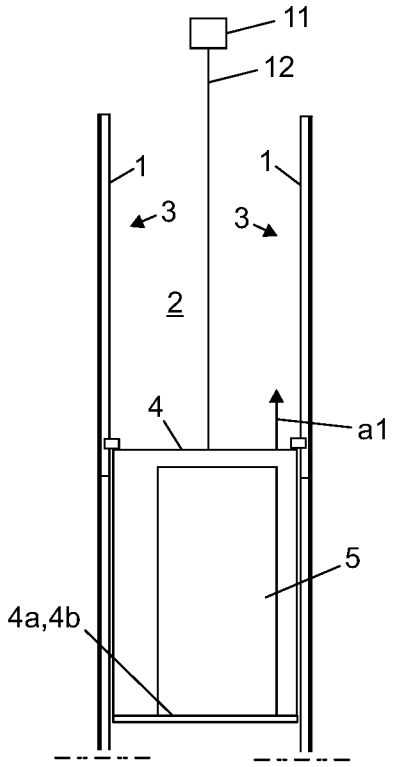
FIG. 12 illustrates a hoisting arrangement that can be used for hoisting the elevator car in the method.

The hoisting arrangement mentioned in description of the installation arrangements according to first or second embodiment can be for example as illustrated in FIG. 12, but it could alternatively be different such as one utilizing the final hoisting machinery and/or ropes of the elevator being under installation. Guide rails 1 and their support equipment have been omitted in FIG. 12. In FIG. 12, the hoisting arrangement comprises a hoist 11 mounted higher than the car 4, and a hoisting rope or hoisting chain movable by the hoist and connected with the car 4.

In a method for installing an elevator, the method comprises the method for installing guide rails 1 of an elevator in a hoistway 2 as described above referring to the first or second embodiment, and thereafter taking the elevator into use for transporting passengers. In said use, the elevator car 4 is moved under automatic control in response to passenger input received via one or more user interfaces, said control preferably being performed by an electronic elevator control system comprising one or more electrically powered microprocessors for example.

Above the method has been described where the guide rails 1 are primarily car guide rails. However, if the elevator comprises a counterweight, the plurality of guide rails 1 can also comprise guide rails 1 of the counterweight, which can be installed similarly as the car guide rails 1.

Figure 13:
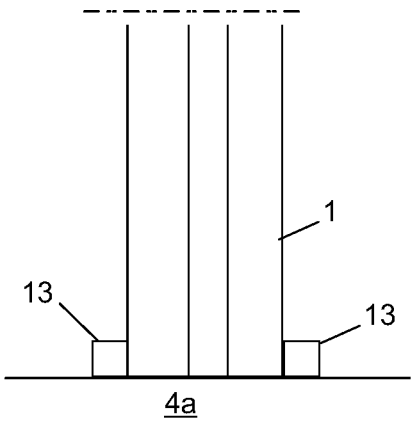
FIG. 13 illustrates a second support equipment used for supporting the lower ends of the guide rails laterally on the elevator car for blocking their lateral movement relative to the elevator car.

As illustrated in FIG. 13, it is preferred, although not necessary that in the first embodiment, a second support equipment 13 is used for supporting the lower ends of the guide rails laterally on the elevator car 4 for blocking their lateral movement relative to the elevator car 4. In this case, the method comprises, such as after the placing and before said hoisting, supporting the lower ends of the guide rails 1 laterally on the elevator car 4 for blocking their lateral movement relative to the elevator car 4. Said supporting is preferably performed using a second support equipment 13, such as one or more brackets mounted on the car, such as one or more timber elements 13.

One or more of the steps of the installation methods could be arranged to be performed automatically. This would make the installation process more efficient. For example, the step of placing plurality of guide rails 1 to stand as defined could be performed automatically by a robot. For example, the hoisting could be controlled automatically by a computer for controlling a hoisting arrangement 11,12. For example, installing a guide rail 1 belonging to said plurality into the elevator hoistway 2 as defined could be performed automatically by a robot, such as a robot carried by the car 4. Performing all these steps automatically by a robot and/or computer, would particularly make the guide rail installation process highly efficient.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A method for installing guide rails of an elevator in a hoistway, comprising the steps of:

installing one or more guide rails to form a vertical guide rail line;

positioning an elevator car at a first position in the hoistway;

placing a plurality of guide rails to stand in an upright position on the elevator car such that each of the guide rails rests on the floor structure of the elevator car;

supporting an upper half of each of the guide rails laterally on the elevator car for blocking any movement in a first lateral direction relative to the elevator car;

hoisting the elevator car in the hoistway upwards to a second position, along the guide rail line; and installing a guide rail belonging to said plurality into the elevator hoistway on top of the guide rail line for extending the guide rail line vertically, thereby making the guide rail being installed to form the uppermost section of the guide rail line, wherein in said placing, said plurality of guide rails are placed to stand on the sill structure such that each of said plurality of guide rails extends along an exterior surface of a side of the elevator car.

2. The method according to claim 1, wherein the method comprises after said installing, hoisting the elevator car in the hoistway upwards to a third position, and installing a guide rail belonging to said plurality of guide rails into the elevator hoistway on top of the guide rail line for extending the guiderail line vertically, thereby making the guide rail being installed to form the uppermost section of the guide rail line.

3. The method according to claim 1, wherein the method comprises after installing all guide rails belonging to said plurality of guide rails, returning the car to a lower position, for picking up a second plurality of guide rails, and thereafter repeating said placing and supporting and thereafter hoisting the elevator car in the hoistway upwards along the guide rail line, and thereafter installing a guide rail belonging to the second plurality into the elevator hoistway on top of the guide rail line for extending the guiderail line vertically, thereby making the guide rail being installed to form the uppermost section of the guide rail line.

4. The method according to claim 1, wherein said supporting the upper half of each of the guide rails laterally on the elevator car comprises supporting the upper half of each of the guide rails laterally on the elevator car with support equipment.

5. The method according to claim 4, wherein the support equipment-comprises a plurality of seats for guide rails, each seat being arranged to receive one guide rail.

6. The method according to claim 5, wherein the seats are guide rail openings, each being arranged to receive one guide rail such that the guide rail extends through the guide rail opening.

7. The method according to claim 4, wherein said supporting equipment is mounted on a side of the car at a position higher than an upper edge of a doorway of the car leading into an interior of the car.

8. The method according to claim 1, wherein in said placing, said plurality of guide rails are placed to stand on the floor structure of the elevator car such that said plurality of guide rails rest on an upwards facing face of the floor platform delimiting the interior of the elevator car.

9. The method according to claim 1, wherein in said placing, said plurality of guide rails are placed to stand on the floor structure of the elevator car such that a lower end of each of the guide rails is inside an interior of the elevator car, and an upper end of each of the guide rails is outside the interior of the elevator car.

10. The method according to claim 1, wherein in said placing, said plurality of guide rails are placed to stand on the floor structure of the elevator car such that said plurality of guide rails extend through an opening of the car ceiling have a shape corresponding to a cross sectional shape of the plurality of guide rails.

11. A method for installing an elevator, wherein the method comprises the method for installing guide rails of an elevator in a hoistway according to claim 1, and thereafter taking the elevator into use for transporting passengers.

12. The method according to claim 1, further comprising supporting an upper half of each of the guide rails laterally on the elevator car for blocking any movement in a second lateral direction relative to the elevator car, the second lateral direction being perpendicular to the first lateral direction.

13. An installation arrangement of guide rails for an elevator, comprising:

a hoistway;

one or more guide rails forming a vertical guide rail line;

an elevator car at a first position in the hoistway;

plurality of guide rails placed to stand in an upright position on the elevator car such that each of the guide rails rests on a floor structure of the elevator car;

the upper half of each of the guide rails being supported laterally on the elevator car for blocking any movement in a first lateral direction relative to the elevator car; and a hoisting arrangement for hoisting the elevator car in the hoistway upwards to a second position, along the guide rail line, wherein said floor structure is a sill structure extending outwardly from a side of the elevator car.

14. The arrangement according to claim 13, further comprising the upper half of each of the guide rails being supported laterally on the elevator car for blocking any movement in a second lateral direction, the second lateral direction being perpendicular to the first lateral direction.

15. The arrangement according to claim 13, further comprising:

an opening in a top of the elevator car; and a cover for the opening, the cover having a plurality of openings, each opening receiving one of the plurality of guide rails.

16. The arrangement according to claim 13, further comprising a T-shaped opening in a top of the elevator car.

17. The arrangement according to claim 13, wherein the elevator car comprises a top wall, a bottom wall, a front wall having a door and at least one side wall extending from the top wall to the bottom wall.

18. An installation arrangement of guide rails for an elevator, comprising:

a hoistway;

one or more guide rails forming a vertical guide rail line;

an elevator car at a first position in the hoistway;

plurality of guide rails placed to stand in an upright position on the elevator car such that each of the guide rails rests on a floor structure of the elevator car;

the upper half of each of the guide rails being supported laterally on the elevator car for blocking any movement in a first lateral direction relative to the elevator car; and a hoisting arrangement for hoisting the elevator car in the hoistway upwards to a second position, along the guide rail line wherein the elevator car comprises side walls extending between a top of the elevator car and the floor structure of the elevator and a door in one of the side walls.

* * * * *